US011028516B2

(12) United States Patent
Lee et al.

(10) Patent No.: US 11,028,516 B2
(45) Date of Patent: Jun. 8, 2021

(54) WASHING MACHINE

(71) Applicant: Samsung Electronics Co., Ltd, Gyeonggi-do (KR)

(72) Inventors: Jung-hee Lee, Suwon-si (KR); Jeong-hoon Kang, Seoul (KR); Kwan-woo Hong, Suwon-si (KR); Min-sung Kim, Yongin-si (KR); Dae-uk Kang, Suwon-si (KR); Kyung-han Kim, Suwon-si (KR); Ju-bum Han, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 67 days.

(21) Appl. No.: 15/737,742

(22) PCT Filed: Jul. 11, 2017

(86) PCT No.: PCT/KR2017/007419
§ 371 (c)(1),
(2) Date: Nov. 14, 2018

(87) PCT Pub. No.: WO2018/012852
PCT Pub. Date: Jan. 18, 2018

(65) Prior Publication Data

US 2019/0071811 A1 Mar. 7, 2019

(30) Foreign Application Priority Data

Jul. 12, 2016 (KR) ..... 10-2016-0088041
Jun. 29, 2017 (KR) ..... 10-2017-0082273

(51) Int. Cl.
*D06F 37/06* (2006.01)
*D06F 23/06* (2006.01)
(Continued)

(52) U.S. Cl.
CPC ..... *D06F 37/06* (2013.01); *D06F 23/06* (2013.01); *D06F 37/04* (2013.01); *D06F 23/02* (2013.01)

(58) Field of Classification Search
CPC ..... D06F 37/06; D06F 37/065; D06F 37/04; D06F 23/02; D06F 23/06; D06F 37/12;
(Continued)

(56) References Cited

U.S. PATENT DOCUMENTS 8,181,355 B2 5/2012 Geyer et al.
8,887,535 B2 11/2014 Hashimoto
(Continued)

FOREIGN PATENT DOCUMENTS

CN 203420126 U 2/2014
CN 204849374 U 12/2015
(Continued)

OTHER PUBLICATIONS

Supplementary European Search Report dated Jul. 2, 2018 in connection with European Patent Application No. 17 81 2296.
(Continued)

*Primary Examiner* — Michael E Barr
*Assistant Examiner* — Omair Chaudhri

(57) ABSTRACT

A washing machine including a washing tub capable of improving a washing effect and dehydration efficiency of the laundry is provided. The washing machine includes: a body; a washing tub configured to be rotatably provided in the body, accommodate a laundry therein, and have a cylindrical shape; a plurality of recessed portions configured to be formed in an inner circumferential surface of the washing tub and be arranged in the plural in a circumferential direction of the washing tub to form a pattern; and first dehydrating holes configured to be formed in the respective
(Continued)

recessed portions, wherein the respective recessed portions are formed in a length direction of the washing tub.

6 Claims, 18 Drawing Sheets

(51) Int. Cl.
*D06F 37/04* (2006.01)
*D06F 23/02* (2006.01)

(58) Field of Classification Search
CPC ..... D06F 37/14; D06F 37/145; D06F 23/04; D06F 39/12
See application file for complete search history.

(56) References Cited

U.S. PATENT DOCUMENTS

| | | | | |
|---|---|---|---|---|
| 2010/0326142 | A1* | 12/2010 | Geyer | D06F 37/06 68/139 |
| 2011/0088276 | A1* | 4/2011 | Geyer | D06F 37/04 34/108 |
| 2011/0100068 | A1* | 5/2011 | Simsek | D06F 37/06 68/19 |
| 2013/0213097 | A1* | 8/2013 | Kim | D06F 37/065 68/140 |
| 2014/0096570 | A1 | 4/2014 | Jang et al. | |
| 2015/0252512 | A1* | 9/2015 | Jeon | D06F 37/14 68/132 |
| 2015/0337480 | A1* | 11/2015 | Lee | D06F 39/028 68/17 R |
| 2018/0355540 | A1* | 12/2018 | Jeoung | D06F 37/40 |
| 2020/0149205 | A1* | 5/2020 | Jeoung | D06F 37/06 |

FOREIGN PATENT DOCUMENTS

| | | | | | |
|---|---|---|---|---|---|
| CN | 105544148 | A | * | 5/2016 | |
| EP | 1964960 | A2 | | 9/2008 | |
| EP | 2177656 | A1 | * | 4/2010 | D06F 37/06 |
| EP | 2177657 | A1 | | 4/2010 | |
| EP | 2628839 | A1 | | 8/2013 | |
| JP | 08117485 | A | | 5/1996 | |
| JP | H09-266998 | A | | 10/1997 | |
| JP | 2010022645 | A | | 2/2010 | |
| JP | 1652306 | B2 | | 3/2011 | |
| JP | 5044498 | B2 | | 10/2012 | |
| JP | 2015002906 | A | | 1/2015 | |
| KR | 10-2000-0024965 | A | | 5/2000 | |
| KR | 20000024965 | A | * | 5/2000 | |
| KR | 100457583 | B1 | | 11/2004 | |
| KR | 10-0644823 | B1 | | 11/2006 | |
| KR | 10-2013-0095604 | A | | 8/2013 | |
| KR | 20140046718 | A | | 4/2014 | |
| KR | 20140046981 | A | | 4/2014 | |
| KR | 10-2015-0105092 | A | | 9/2015 | |

OTHER PUBLICATIONS

Examination Report in connection with Indian Application No. 201717045836 dated Jan. 27, 2020, 7 pages.
International Search Report dated Oct. 31, 2017 in connection with International Patent Application No. PCT/KR2017/007419.
Written Opinion of the International Searching Authority dated Oct. 31, 2017 in connection with International Patent Application No. PCT/KR2017/007419.
Communication pursuant to Article 94(3) EPC dated May 11, 2020 in connection with European Patent Application No. 17 812 296.6, 6 pages.
Communication pursuant to Article 94(3) EPC dated Feb. 1, 2021 in connection with European Patent Application No. 17 812 296.6, 5 pages.

* cited by examiner

WASHING MACHINE

CROSS-REFERENCE TO RELATED APPLICATIONS

The present application is a National Stage of International Application No. PCT/KR2017/007419 filed Jul. 11, 2017, which claims the benefit of Korean Patent Application No. 10-2016-0088041 filed Jul. 12, 2016 and Korean Patent Application No. 10-2017-0082273 filed Jun. 29, 2017, the disclosures of which are fully incorporated herein by reference into the present disclosure as if fully set forth herein.

TECHNICAL FIELD

Apparatuses consistent with the present disclosure relate to a washing machine including a washing tub capable of improving a washing effect of the laundry.

BACKGROUND

In general, a washing machine is divided into a pulsator type washing machine and a drum type washing machine depending on a washing manner, and both of the pulsator type washing machine and the drum type washing machine include a water tub and a washing tub.

In the pulsator type washing machine, a driving shaft of the washing tub in which washing is performed is provided to be perpendicular to the ground. A pulsator generating a flow of washing water is installed at a lower portion of the washing tub. In the pulsator type washing machine, the pulsator agitates the laundry and the washing water injected into the washing tub together to remove dirty from the laundry, while the washing tub and the pulsator being rotated by a motor in a state in which the laundry and the washing water are injected into the washing tub.

In the drum type washing machine, washing is performed by head drop. A lifter for lifting the laundry is disposed in the washing tub.

In the pulsator type washing machine and the drum type washing machine, dehydrating holes allowing water of the water tub to be introduced into the washing tub and allowing the water of the washing tub to be drained from the washing tub at the time of drainage or dehydration are provided in a circumferential portion of the washing tub.

In the related art, the dehydrating holes are arranged in an inner surface of the washing tub that is flat. In this case, friction between the inner surface of the washing tub and the laundry is not large, such that there is a limitation in improving a washing effect by the friction.

In addition, in the drum type washing machine according to the related art, a case in which the laundry is gathered toward an inlet (front) in a washing or dehydrating process occurs, and a case in which the laundry is gathered toward the inlet is sandwiched and damaged in a diaphragm connecting a body and the water tub to each other or between a door and the inlet occurs.

SUMMARY

The present disclosure provides a washing machine capable of improving a washing effect and dehydration efficiency.

The present disclosure also provides a washing machine capable of increasing a dehydration ratio by preventing a dehydration bottleneck phenomenon.

The present disclosure also provides a washing machine in which rigidity of a washing tub may be increased by continuously providing pattern sections on a surface of the washing tub.

The present disclosure also provides a washing machine capable of preventing the laundry from being gathered toward the front of a washing tub.

According to an aspect of the present disclosure, a washing machine includes: a body; a washing tub configured to be rotatably provided in the body, accommodate a laundry therein, and have a cylindrical shape; a plurality of recessed portions configured to be formed in an inner circumferential surface of the washing tub and be arranged in the plural in a circumferential direction of the washing tub to form a pattern; and first dehydrating holes configured to be formed in the respective recessed portions, wherein the respective recessed portions are formed in a length direction of the washing tub.

The recessed portions may be formed in a direction parallel with a driving shaft driving the washing tub.

The may include a first pattern section and a second pattern section spaced apart from each other and arranged in a direction of the driving shaft, and the washing machine may further include at least one second dehydrating hole configured to be formed between the first pattern section and the second pattern section.

The first dehydrating holes may be formed at both end portions of the recessed portion, respectively.

The recessed portion may be recessed from the inner circumferential surface of the washing tub toward the outside of the washing tub, and include a first inclined surface inclined downwardly in the circumferential direction of the washing tub and a second inclined surface connected to the first inclined surface and inclined upwardly in the circumferential direction of the washing tub.

The first dehydrating holes may be formed in a contact portion between the first inclined surface and the second inclined surface.

The recessed portion may include a connecting surface flatly connecting the first inclined surface and the second inclined surface to each other.

The first dehydrating holes may be formed in the connecting surface.

The recessed portion may include a guide groove formed in the connecting surface, the first dehydrating hole may be positioned in the guide groove, and the guide groove may have a shape inclined toward the first dehydrating hole.

The recessed portions may be arranged in a direction inclined with respect to the driving shaft driving the washing tub.

According to another aspect of the present disclosure, a washing machine includes: a body configured to have an inlet formed in a front surface thereof; a washing tub configured to be rotatably disposed in the body, accommodate a laundry injected through the inlet therein, and have a cylindrical shape; and a plurality of protruding portions configured to protrude from an inner circumferential surface of the washing tub toward an inner portion of the washing tub to form a pattern, wherein at least part of the respective protruding portions are curved in a helix direction from a portion adjacent to the inlet in a direction that becomes distant from the inlet.

The washing tub may be configured to rotate in a counterclockwise direction at the time of performing dehydration, and the at least part of the protruding portion may be curved in a right handed screw direction.

The protruding portion may include a front end portion adjacent to the inlet, a central portion connected to the front end portion, and a rear end portion connected to the central portion, the central portion may be curved in the right handed screw direction, and the front end portion and the rear end portion may be parallel with a shaft of the washing tub.

The protruding portion may include a plurality of recessed portions formed in a length direction of the protruding portion.

The recessed portion may have an oval shape extended in the length direction of the protruding portion.

The protruding portion may include at least one first dehydrating hole formed in the recessed portion.

The protruding portion may include at least one second dehydrating hole formed between the plurality of recessed portions.

The plurality of protruding portions may be disposed in parallel with each other in a circumferential direction of the washing tub.

The washing tub may include at least one third dehydrating hole formed between the plurality of protruding portions.

The protruding portion may have a helix shape extended from a front end of the washing tub toward a rear end of the washing tub in a direction opposed to a rotation direction of the washing tub.

DETAILED DESCRIPTION

Figure 1:
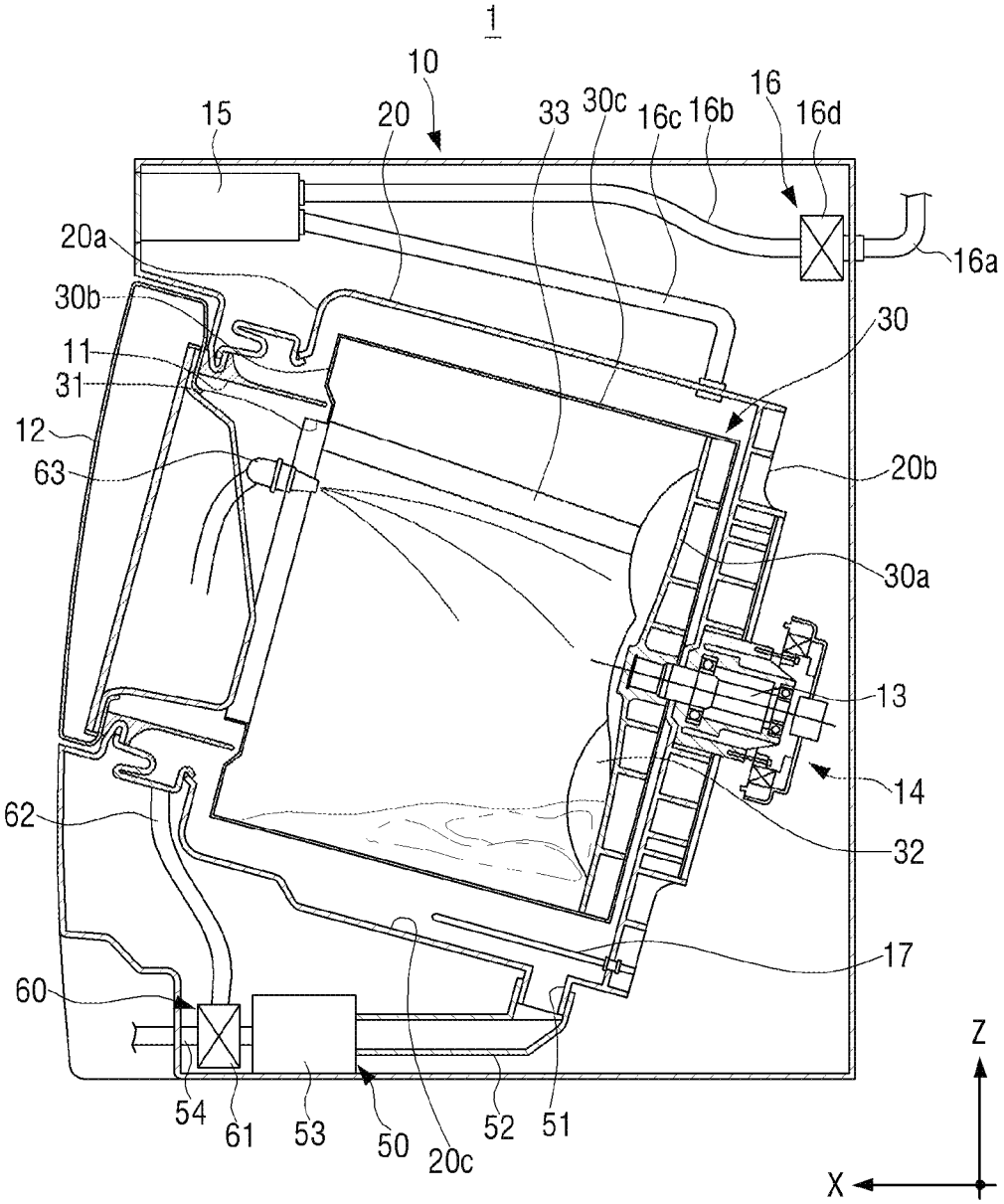
FIG. 1 is a cross-sectional view illustrating a washing machine according to an exemplary embodiment of the present disclosure.

Hereinafter, exemplary embodiments of the present disclosure will be described in more detail with reference to FIGS. 1 through 18. Exemplary embodiments to be described below will be described on the basis of exemplary embodiments most appropriate for understanding technical features of the present disclosure, and these exemplary embodiments do not limit the technical features of the present disclosure, but exemplify that the present disclosure may be implemented like these exemplary embodiments.

Therefore, the present disclosure may be variously modified without departing from the technical scope of the present disclosure through exemplary embodiments to be described below, and these modifications will be to fall within the technical scope of the present disclosure. In addition, to assist in the understanding of exemplary embodiments to be described below, components performing the same operations and related components in the respective exemplary embodiments will be denoted by the same or similar reference numerals throughout the accompanying drawings.

A drum washing machine will hereinafter be described by way of example, but the present disclosure is not limited thereto. That is, a configuration of a washing tub according to the present disclosure may also be applied to a top load-type automatic washing machine.

Figure 2:
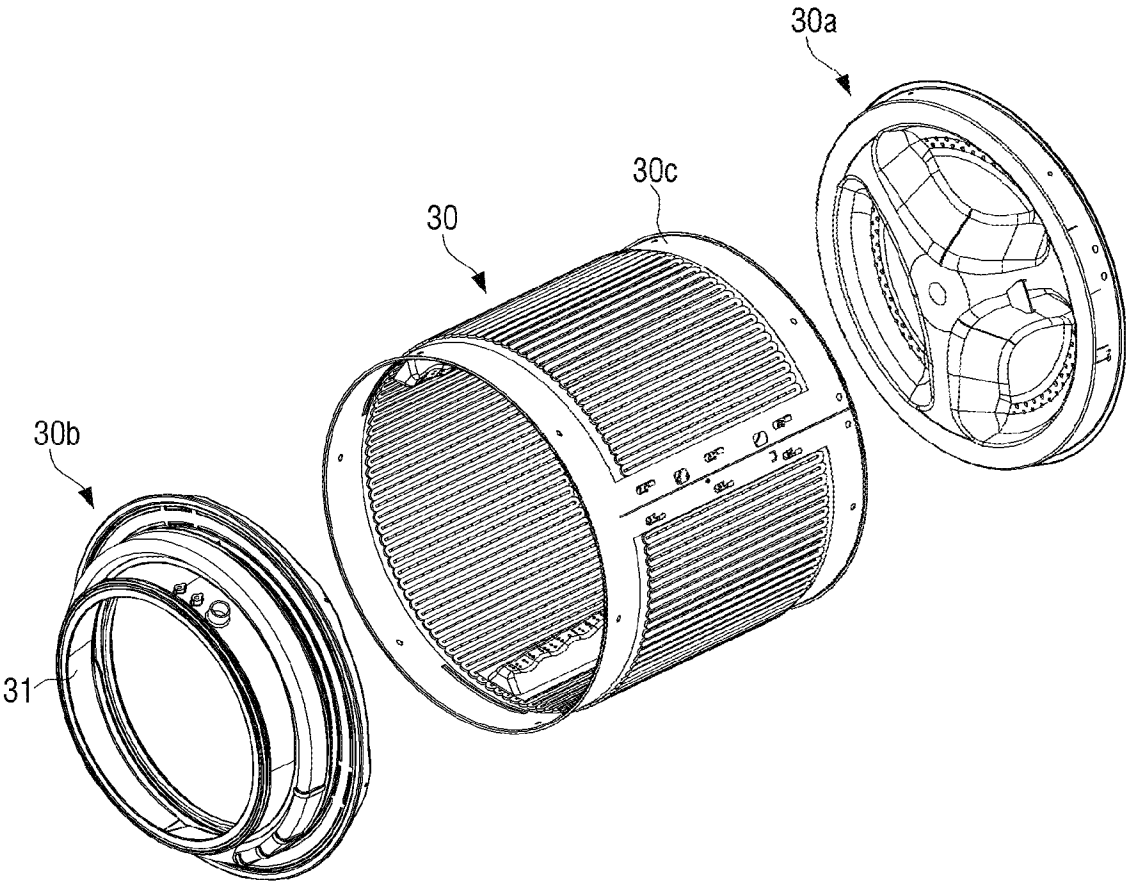
FIG. 2 is an exploded perspective view illustrating a washing tub according to an exemplary embodiment of the present disclosure.

FIG. 1 is a cross-sectional view illustrating a washing machine according to an exemplary embodiment of the present disclosure, and FIG. 2 is an exploded perspective view illustrating a washing tub according to an exemplary embodiment of the present disclosure.

Referring to FIGS. 1 and 2, the washing machine according to an exemplary embodiment of the present disclosure includes a body 10 having a front surface in which an inlet 11 for injecting the laundry is formed, a water tub 20 installed in the body 10 and storing washing water therein, and a washing tub 30 rotatably provided in the water tub 20 and accommodating the laundry therein. In addition, the washing machine includes a door 12 opening or closing the inlet 11 of the body 10.

The water tub 20 is installed to be inclined at an predetermined angle with respect to an installation surface of the washing machine 1 so that a front surface portion 20*a* thereof in which an inlet is formed is positioned to be higher than that of a rear surface portion 20*b* thereof, and the washing tub 30 disposed in the water tub 20 is also installed to be inclined in the same form as that of the water tub 20. However, the water tub and the washing tub are not limited thereto, but may also be installed not to be inclined.

The washing tub 30 is rotatably supported by a driving shaft 13 coupled to a rear surface portion 30*a* thereof and penetrating through the rear surface portion 20*b* of the water tub 20. In addition, a driving motor 14 rotating the driving shaft 13 is installed outside the rear surface portion 20*b* of the water tub 20. The driving motor 14 rotates the driving shaft 13, such that the washing tub 30 disposed in the water tub 20 may rotate. The driving motor 14 rotates the washing tub 30 at a low speed at the time of performing washing, and rotates the washing tub 30 at a high speed in one direction at the time of performing dehydration.

A detergent supplying device 15 for supplying a detergent to an inner portion of the water tub 20 and a water supplying device 16 for supplying washing water to the inner portion of the water tub 20 are installed above the water tub 20. The detergent supplying device 15 is installed at the front surface portion of the body 10. The water supplying device 16 includes a first water supplying pipe 16*b* connecting between an external water supplying pipe 16*a* and the detergent supplying device 15, a second water supplying pipe 16*c* connecting the detergent supplying device 15 and the water tub 20, and a water supplying control valve 16*d* installed on the first water supplying pipe 16*b* and controlling water supplying. This is to allow the water supplied to the inner portion of the water tub 20 to pass through the detergent supplying device 15 to allow the detergent to be supplied together with the water to the water tub 20.

A heater 17 heating the washing water of the water tub 20 is installed at a lower portion of an inner side of the water tub 20. A heater accommodating portion 20*c* protruding downwardly is provided at a lower portion of the water tub 20 to install the heater 17. This is to allow the washing water to be collected in the heater accommodating portion 20*c* while allowing the heater 17 to be accommodated in the heater accommodating portion 20*c*.

A water draining device 50 for draining the washing water of the water tub 20 and a washing water circulating device 60 for supplying the washing water in the water tub 20 into the washing tub 30 are installed below outside of the water tub 20. The water draining device 50 includes a first water draining pipe 52 connected to a drainage hole 51 installed at the lower portion of the water tub 20, a water draining pump 53 installed on the first water draining pipe 52, and a second water draining pipe 54 connected to an outlet of the water draining pump 53.

The washing water circulating device 60 includes a flow path switching valve 61 installed on the second water draining pipe 54 connected to the outlet of the water draining pump 53, a washing water circulating pipe 62 extended from the flow path switching valve 61 to an inlet 31 of the washing tub 30, and a spraying nozzle 63 installed at an outlet of the washing water circulating pipe 62. The flow path switching valve 61 may switch a flow path so that the washing water of the outlet of the water draining pump 53 is drained to the outside or flows to the washing water circulating pipe 62.

The flow path switching valve 61 may be a general electromotive three-way valve. This is to allow the washing water in the water tub 20 to be sprayed to an inner portion of the washing tub 30 through the first water draining pipe 52 and the washing water circulating pipe 62 when the water draining pump 53 is operated in a state in which the flow path switching valve 61 is operated so that the washing water flows to the washing water circulating pipe 62. When the water draining pump 53 is operated in a state in which the flow path switching valve 61 is operated so that the washing water flows to the second water draining pipe 54 guiding the washing water to the outside, the washing water of the water tub 20 is drained.

The washing tub 30 may have a cylindrical shape, and includes the rear surface portion 30*a* coupled to the driving shaft 13, a front surface portion 30*b* in which the inlet 31 is formed, and a circumferential portion 30*c* having both ends each coupled to the front surface portion 30*b* and the rear surface portion 30*a* and having a cylindrical shape. A plurality of lifters 33 lifting and dropping the laundry in the washing tub 30 when the washing tub 30 rotates are installed on an inner surface of the circumferential portion 30*c* of the washing tub 30, and a plurality of agitating protrusion 32 for improving washing force are formed on an inner surface of the rear surface portion 30*a* of the washing tub 30. In addition, a pattern 40 including one or more recessed portions 42 and one or more dehydrating holes 43 are arranged on an inner surface of the washing tub 30.

The inner surface of the circumferential portion 30*c* of the washing tub 30 configures an inner circumferential surface of the washing tub 30.

Figure 3:
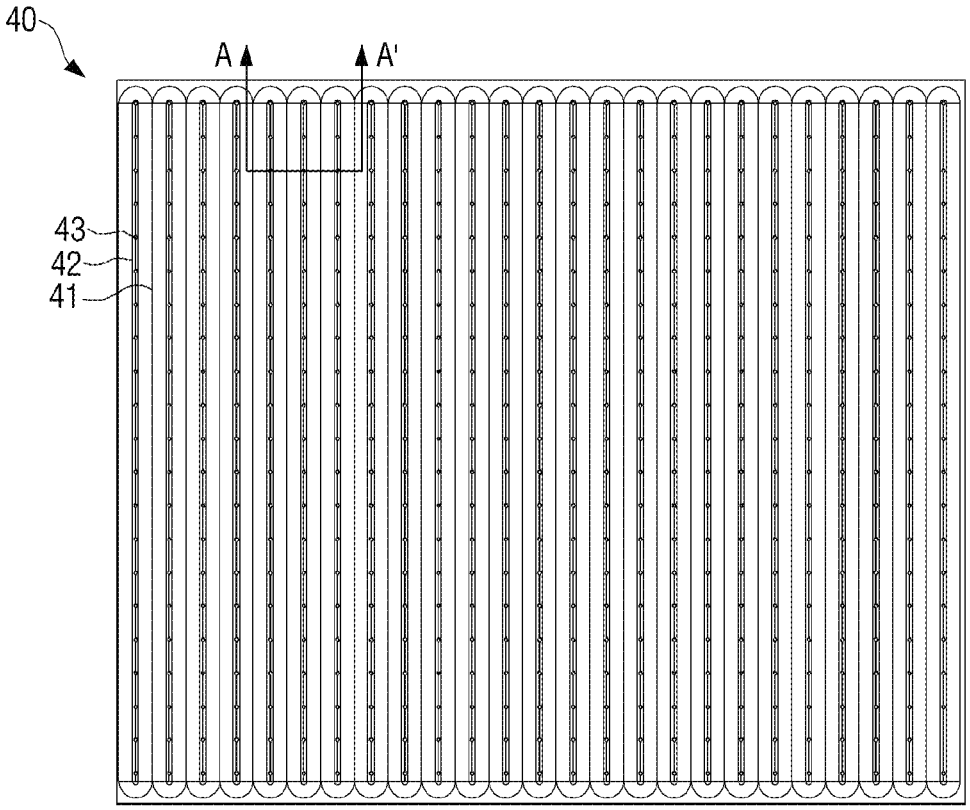
FIG. 3 is a plan view illustrating a state in which a washing tub according to an exemplary embodiment of the present disclosure is unrolled.
Figure 4:
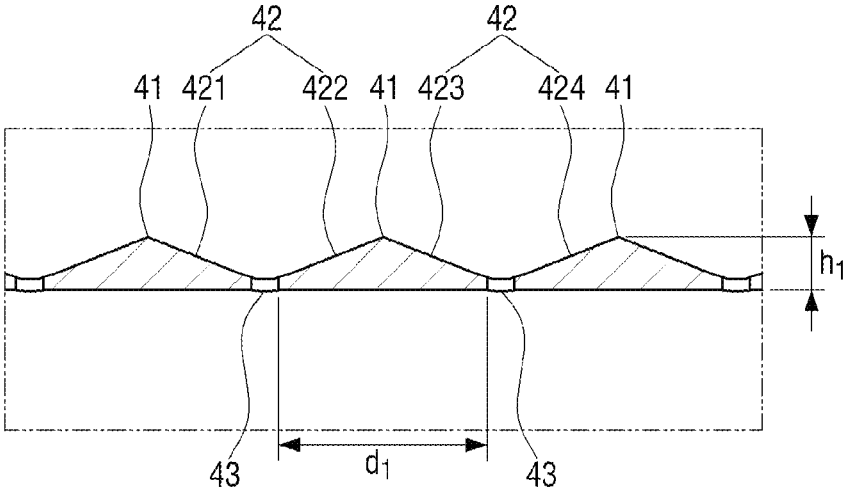
FIG. 4 is a cross-sectional view taken along line A-A' of FIG. 3.

FIG. 3 is a plan view illustrating a state in which a washing tub according to an exemplary embodiment of the present disclosure is unrolled, and FIG. 4 is a cross-sectional view taken along line A-A' of FIG. 3.

Referring to FIGS. 3 and 4, at least one pattern 40 may be provided at an inner side of the washing tub 30 according to an exemplary embodiment of the present disclosure. Hereinafter, one pattern 40 will be mainly described, but an exemplary embodiment of a case in which a plurality of patterns 40 are provided will be described below.

The pattern 40 may include a plurality of recessed portions 42 formed in a length direction of the washing tub 30 in the inner circumferential surface of the washing tub 30. That is, the plurality of recessed portions 42 may be formed in the inner circumferential surface of the washing tub 30, and be arranged in the plural in a circumferential direction of the washing tub 30 to form the pattern 40. In addition, the respective recessed portions 42 are formed in the length direction of the washing tub 30.

The recessed portions 42 are extended from the front surface portion 30*b* in which the inlet 31 is formed to the rear surface portion 30*a* coupled to the driving shaft 13, and the washing tub 30 may include the recessed portions 42 and first dehydrating holes 43 formed in the recessed portions 42. The recessed portions 42 may have a length direction parallel with the driving shaft 13 driving the washing tub 30. In addition, the recessed portions 42 may be arranged in the plural in the circumferential direction of the washing tub 30.

As an example, the recessed portions 42 are recessed from the inner circumferential surface of the washing tub 30 toward the outside of the washing tub 30. In addition, the recessed portion 42 may be formed by a first inclined surface 421 inclined downwardly in the circumferential direction of the washing tub 30 and a second inclined surface 422 connected to the first inclined surface 421 and inclined upwardly in the circumferential direction of the washing tub 30. The first dehydrating holes 43 may be positioned at a contact portion at which the first inclined surface 421 and the second inclined surface 422 are connected to each other, and may be spaced apart from each other by the same interval and be provided in the plural, in the length direction of the recessed portion 42.

A third inclined surface 423, which has a shape corresponding to that of the first inclined surface 421, may be connected to the second inclined surface 422, and a fourth inclined surface 424, which has a shape corresponding to that of the second inclined surface 422, may be connected to the third inclined surface 423. That is, the recessed portions 42 may be continuously arranged in the circumferential direction of the washing tub 30.

The contact portion at which the second inclined surface 422 and the third inclined surface 423 are connected to each other may be defined as a protruding portion 41, and the protruding portion 41 may have a triangular shape. The protruding portion 41 may have a predetermined height $h_1$ in relation to a bottom surface (or an outer circumferential surface) of the washing tub 30. It is effective in improving a moisture content ((weight after washing−weight before washing)/weight before washing*100(%)) that the height of the protruding portion 41 satisfies at least 2 mm or more.

In addition, a linear distance $d_1$ between the second inclined surface 422 and the third inclined surface 423 may have 20 mm or more. In the case in which the linear distance $d_1$ is less than 20 mm, a moisture content improving effect is slight, while in the case in which the linear distance $d_1$ is 20 mm or more, a moisture content improving effect may be improved by about 3% or more.

In addition, frictional force between the laundry and the washing tub 30 may be increased through the pattern 40 including the protruding portions 41 having the triangular shape to improve a flow of the washing water, resulting in an increase in washing force.

Figure 5:
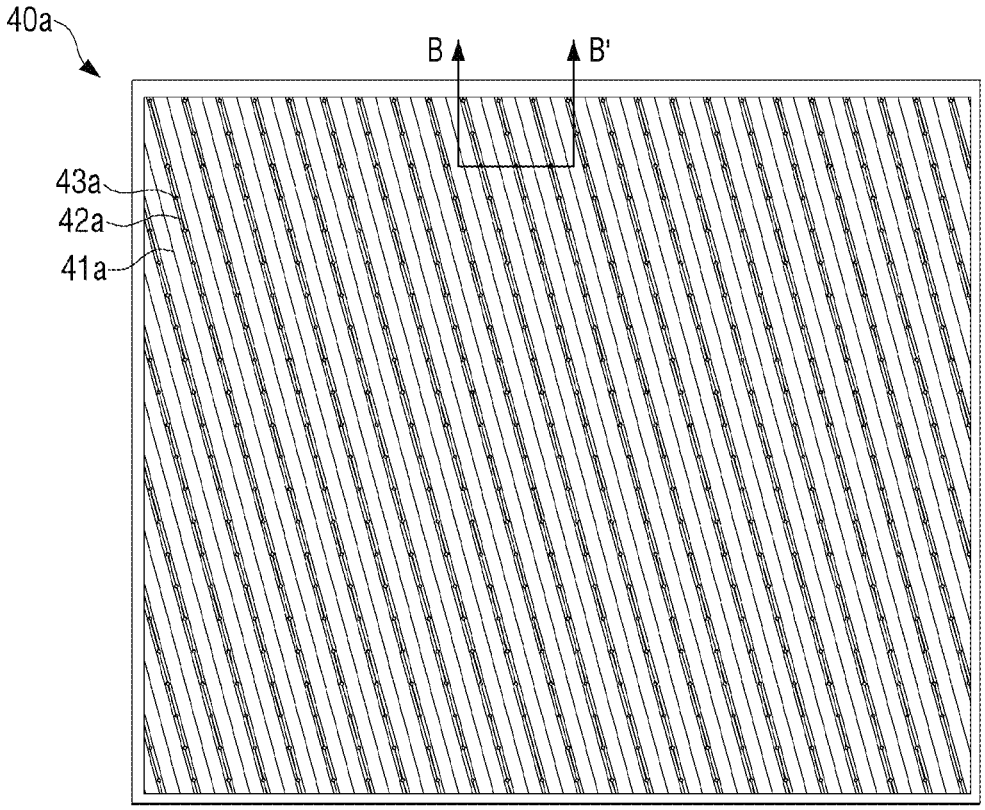
FIG. 5 is a plan view illustrating a state in which a washing tub according to another exemplary embodiment of the present disclosure is unrolled.
Figure 6:
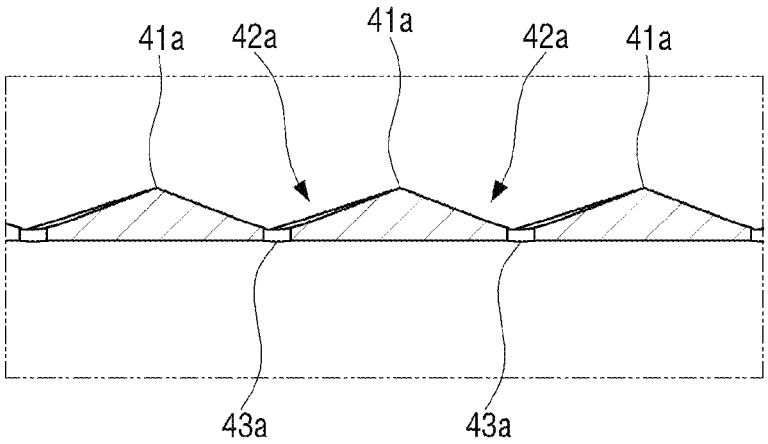
FIG. 6 is a cross-sectional view taken along line B-B' of FIG. 5.

FIG. 5 is a plan view illustrating a state in which a washing tub according to another exemplary embodiment of the present disclosure is unrolled, and FIG. 6 is a cross-sectional view taken along line B-B' of FIG. 5. Hereinafter, contents different from those of the washing tub according to the exemplary embodiment of the present disclosure described with reference to FIGS. 1 to 4 will be mainly described, and contents for which a description is omitted may be replaced by the abovementioned contents.

Referring to FIGS. 5 and 6, at least one pattern 40*a* may be provided at an inner side of the washing tub 30 according to another exemplary embodiment of the present disclosure.

The pattern 40*a* according to another exemplary embodiment of the present disclosure may include recessed portions 42*a* extended from the front surface portion 30*b* in which the inlet 31 is formed to the rear surface portion 30*a* coupled to the driving shaft 13 and first dehydrating holes 43*a* formed in the recessed portions 42*a*. The recessed portions 42 may be arranged in a direction inclined with respect to the driving shaft 13 driving the washing tub 30. In addition, the recessed portions 42 may be spaced apart from each other and be formed in parallel with each other, in the circumferential direction of the washing tub 30. The first dehydrating holes 43*a* may be positioned in the recessed portions 42*a*. Protruding portions 41*a* may be provided between the recessed portions 42*a*, and cross sections of the protruding portions 41*a* may have a triangular shape.

Figure 7:
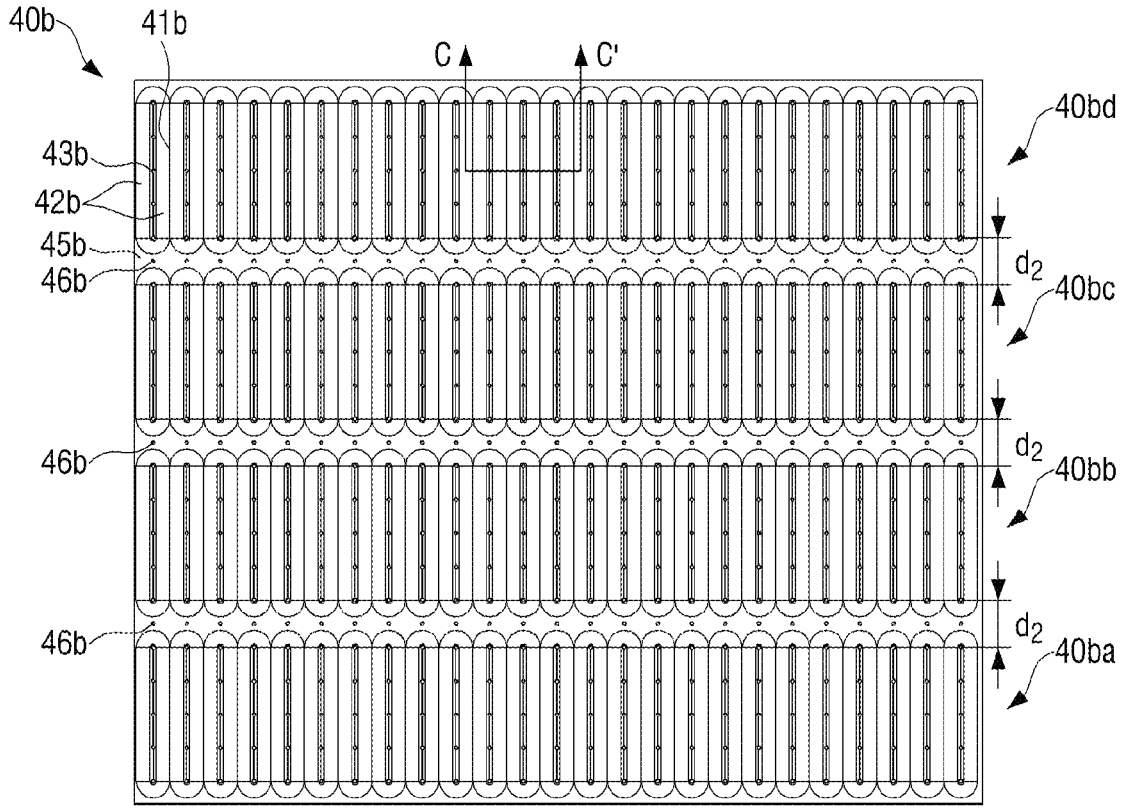
FIG. 7 is a plan view illustrating a state in which a washing tub according to still another exemplary embodiment of the present disclosure is unrolled.
Figure 8:
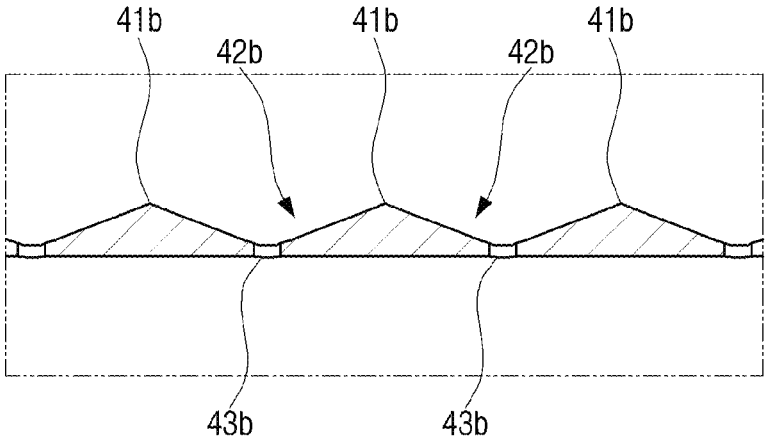
FIG. 8 is a cross-sectional view taken along line C-C' of FIG. 7.

FIG. 7 is a plan view illustrating a state in which a washing tub according to still another exemplary embodiment of the present disclosure is unrolled, and FIG. 8 is a cross-sectional view taken along line C-C' of FIG. 7.

Referring to FIGS. 7 and 8, at least one pattern 40*b* may be provided at an inner side of the washing tub 30 according to still another exemplary embodiment of the present disclosure.

The pattern 40*b* according to still another exemplary embodiment of the present disclosure may include recessed portions 42*b* extended from the front surface portion 30*b* in which the inlet 31 is formed to the rear surface portion 30*a* coupled to the driving shaft 13 and dehydrating holes 43*b* formed in the recessed portions 42*b*. The recessed portions 42*b* may have a length direction parallel with the driving shaft 13 driving the washing tub 30. In addition, the recessed portions 42 may be formed in the plural in parallel with each other in the circumferential direction of the washing tub 30.

As an example, the recessed portions 42*b* may have a length less than ½ of lengths of the front surface portion and the rear surface portion of the washing tub 30, and in the case in which the recessed portions 42*b* have the length less than ½ of the lengths of the front surface portion and the rear surface portion of the washing tub 30, the recessed portions 42*b* may be spaced apart from each other and be arranged in the plural, in a direction of the driving shaft 13.

As an example, referring to FIG. 7, the recessed portions 42*b* may be spaced apart from each other and be arranged as four rows, in the direction of the driving shaft 13. Therefore, the pattern 40*b* may include a plurality of pattern sections. As an example, as illustrated in FIG. 7, the pattern 40*b* may include first to fourth pattern sections 40*ba*, 40*bb*, 40*bc*, and 40*bd* in the direction of the driving shaft 13. As described above, the respective recessed portions 42*b* are provided with the first dehydrating holes 43*b*. In addition, the first dehydrating holes 43*b* may be each formed at both end portions of the recessed portion 42*b*, and one or more first dehydrating holes 42*b* may be additionally provided at the same interval between the first dehydrating holes 42*b* each positioned at both end portions of the recessed portion 42*b*.

As an example, a first dehydrating hole 43*b* formed in the first pattern section 40*ba* and a first dehydrating hole 43*b* formed in the second pattern section 40*bb*, positioned to be closest to the first dehydrating hole 43*b* formed in the first pattern section 40*ba* may be positioned to be spaced apart from each other by a linear distance $d_2$ of 10 mm or more. In addition, first dehydrating holes 43*b* formed in the second pattern section 40*bb* and the third pattern section 40*bc* and first dehydrating holes 43*b* formed in the third pattern section 40*bc* and the fourth pattern section 40*bd* may be positioned to be spaced apart from each other by linear distances $d_2$ of 10 mm or more, respectively. The respective spaced linear distances $d_2$ between the first dehydrating holes 43*b* provided in the respective pattern sections 40*ba*, 40*bb*, 40*bc*, and 40*bd* may be the same as each other. This is to improve workability of the washing tub 30 and maintain strength of the washing tub 30.

In addition, separate second dehydrating holes 46*b* may be formed between the respective pattern sections 40*ba*, 40*bb*, 40*bc*, and 40*bd*. The separate second dehydrating holes 46*b* may be formed between the respective pattern sections 40*ba*, 40*bb*, 40*bc*, and 40*bd* to prevent a dehydration bottleneck phenomenon occurring since dehydration is concentrated on the first dehydrating holes 43*b* of a predetermined pattern, resulting in an increase in a dehydration ratio.

Figure 9:
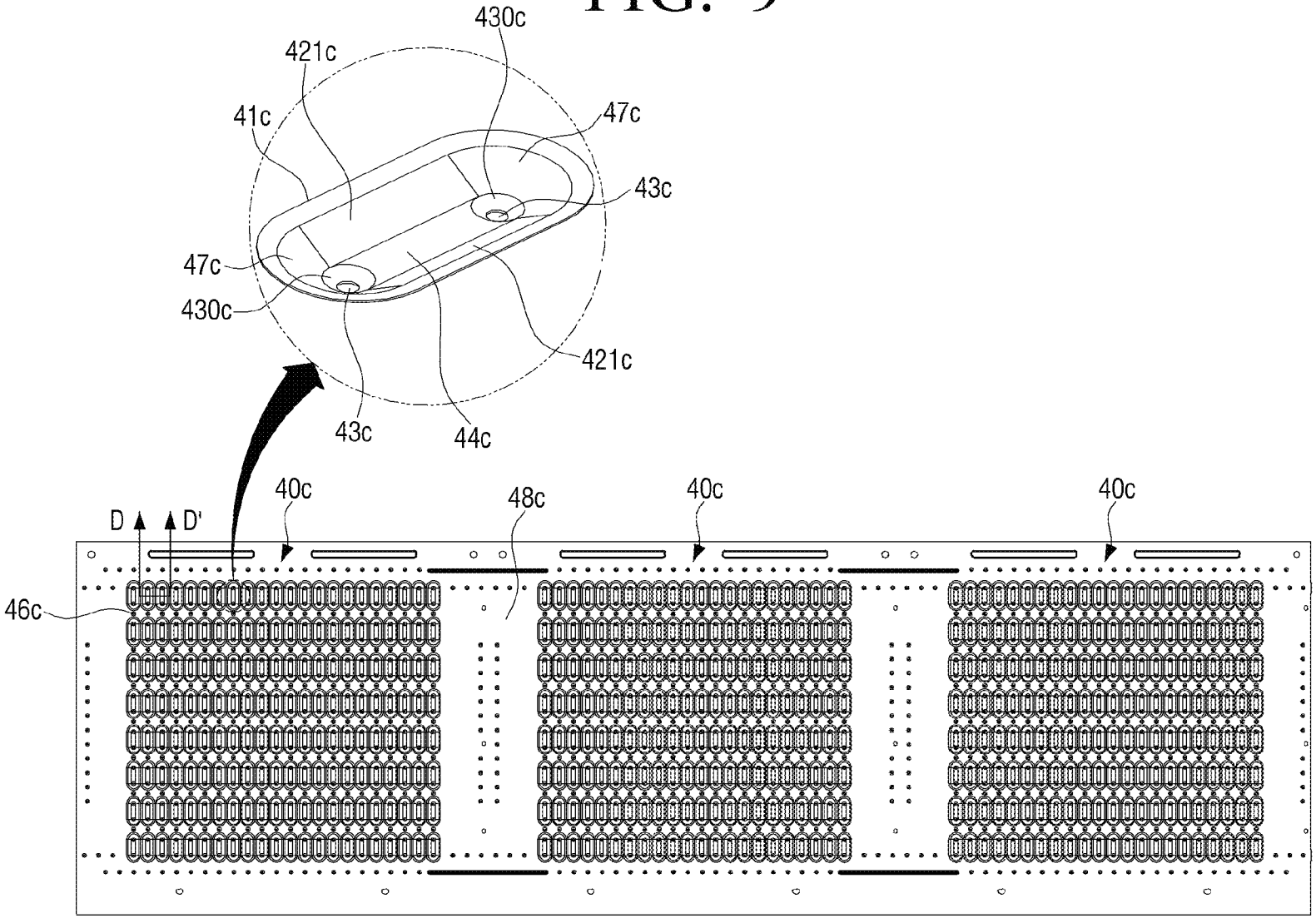
FIG. 9 is a plan view illustrating a state in which a washing tub according to yet still another exemplary embodiment of the present disclosure is unrolled.
Figure 10:
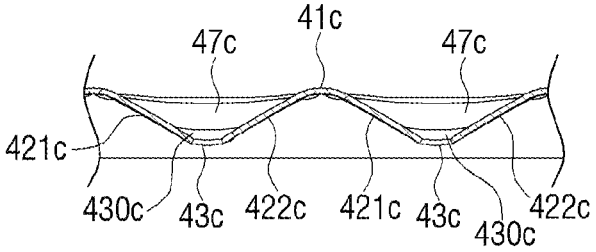
FIG. 10 is a cross-sectional view taken along line D-D' of FIG. 9.

FIG. 9 is a plan view illustrating a state in which a washing tub according to yet still another exemplary embodiment of the present disclosure is unrolled, and FIG. 10 is a cross-sectional view taken along line D-D' of FIG. 9. Hereinafter, contents different from those of the washing tub described with reference to FIGS. 7 and 8 will be mainly described, and contents for which a description is omitted may be replaced by the abovementioned contents.

At least one pattern 40*c* may be provided at an inner side of the washing tub 30.

Various accessories may be coupled to the inner side of the washing tub 30. Examples of the accessories may include the lifter 33 and a guide filter. The lifter 33 may be mainly used in a drum washing machine to smoothly move the laundry, and the guide filter may be mainly used in an automatic washing machine. Portions of the washing tub 30 to which these accessories are coupled are defined as coupled portions 48*c*.

The respective patterns 40*c* positioned at the inner side of the washing tub 30 may be positioned with the coupled portions 48 put as boundaries therebetween. That is, in the case in which the number of coupled portions 48*c* is one, two patterns 40*c* may be provided, and in the case in which the number of coupled portions 48*c* is two, three patterns 40*c* may be provided.

The pattern 40*c* may include recessed portions 42*c* extended from the front surface portion 30*b* in which the inlet 31 is formed to the rear surface portion 30*a* coupled to the driving shaft 13 and first dehydrating holes 43*c* formed in the recessed portions 42*c*. The recessed portions 42*c* may have a length direction parallel with the driving shaft 13 driving the washing tub 30. In addition, the recessed portions 42*c* may be formed in the plural in parallel with each other in the circumferential direction of the washing tub 30. The recessed portions 42*c* may be spaced apart from each other and be arranged in the plural, in the direction of the driving shaft 13.

Referring to FIGS. 9 and 10, the recessed portions 42*c* may be spaced apart from each other and be arranged as a plurality of rows, in the direction of the driving shaft 13. As an example, the recessed portions 42*c* may be arranged in eight rows in the direction of the driving shaft 13. As described above, the respective recessed portions 42*c* are provided with the first dehydrating holes 43. In addition, the first dehydrating holes 43*c* may be each positioned at both end portions of the recessed portion 42*c*, and separate first dehydrating holes 43*c* may be further provided at the same interval between the first dehydrating holes 43*c* each positioned at both end portions of the recessed portion 42*c*. In addition, second dehydrating holes 46*c* may be formed between the respective recessed portions 42*c*.

The recessed portion 42*c* may include a first inclined surface 421*c* inclined downwardly in the circumferential direction of the washing tub 30, a second inclined surface 422*c* connected to the first inclined surface 421*c* and inclined upwardly in the circumferential direction of the washing tub 30, and a first connecting surface 44*c* flatly connecting the first inclined surface 421*c* and the second inclined surface 422*c* to each other. In addition, the recessed portion 42*c* may further include second connecting surfaces 47*c* each connecting between the first connecting surface 421*c* and the respective inclined surfaces 421*c* and 422*c*. A protruding portion 41*c* connecting the first inclined surface 421*c* and the second inclined surface 422*c* to each other may have a round shape.

The first dehydrating holes 43*c* may be provided in the plural at both end portions of the first connecting surface 44*c*. Although not illustrated, the first dehydrating holes 43*c* may be additionally provided between the first dehydrating holes 43*c* each positioned at both end portions of the first connecting surface 44*c*.

Guide grooves 430*c* may be formed in the first connecting surface 44*c*. The guide groove 430*c* may be positioned to have an outer diameter greater than that of the first dehydrating hole 43*c* formed in the first connecting surface 44*c* and be concentric with the first dehydrating hole 43*c*. The guide groove 430*c* may have a shape of which a cross sectional area is decreased toward the first dehydrating hole 43*c*. As an example, a distance between an outer circumferential surface of the guide groove 430*c* and an outer circumferential surface of the first dehydrating hole 43*c* may be 1 mm or more. The distance between the outer circumferential surface of the guide groove 430*c* and the outer circumferential surface of the first dehydrating hole 43*c* may be set to 1 mm or more to improve a moisture content of the laundry by 1% or more.

That is, the washing machine 1 that may increase the washing force of the laundry and maximize dehydration efficiency of the laundry using the patterns 40, 40*a*, 40*c*, and 40*c* according the diverse exemplary embodiment of the present disclosure may be provided. In addition, the patterns 40, 40*a*, 40*c*, and 40*c* having an improved structure may be provided to maximize rigidity of the washing tub 30, such that a user may use the washing tub 30 and the washing machine 1 for a long period of time.

Figure 11:
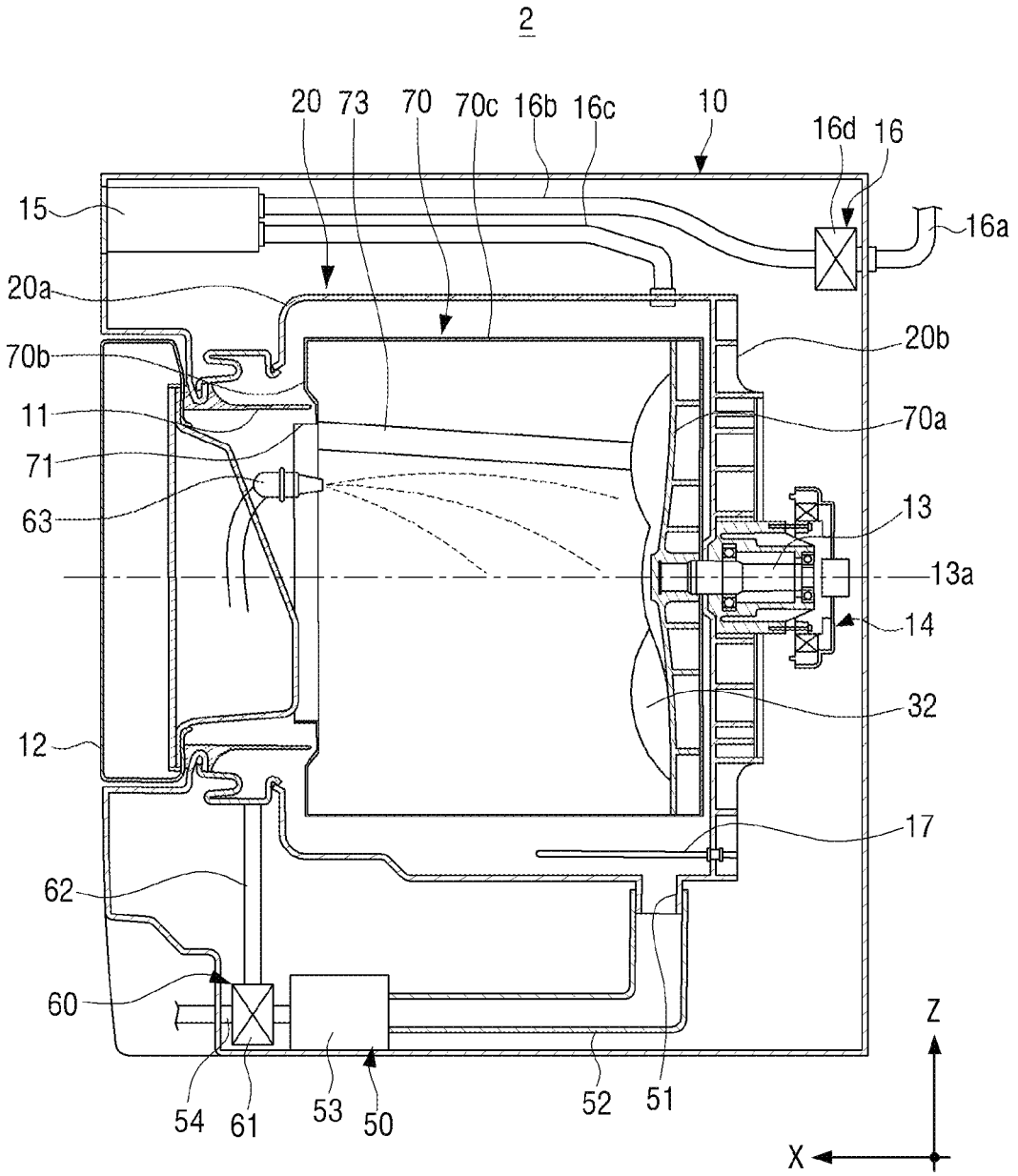
FIG. 11 is a cross-sectional view illustrating a washing machine according to another exemplary embodiment of the present disclosure.

FIG. 11 is a cross-sectional view illustrating a washing machine 2 according to another exemplary embodiment of the present disclosure.

Since most of the structures of the washing machine 2 illustrated in FIG. 11 are similar to those of the washing machine 1 illustrated in FIG. 1, a description for contents overlapping those of the washing machine 1 illustrated in FIG. 1 will be omitted.

However, the washing machine 2 according to another exemplary embodiment of the present disclosure is different from the washing machine 1 illustrated in FIG. 1 in that a water tub 20 and a washing tub 70 disposed in a body 10 are disposed in a direction approximately horizontal to an installation surface of the washing machine 2.

However, as described above, disposition structures of the water tub 20 and the washing tub 70 are not limited thereto. That is, the water tub 20 and the washing tub 70 may be disposed to be inclined with respect to the installation surface of the washing machine 2 as in the washing machine 1 according to an exemplary embodiment of the present disclosure.

The washing machine 2 includes the body 10 having a front surface in which an inlet 11 for injecting the laundry is formed, the water tub 20 installed in the body 10 and storing washing water therein, and the washing tub 70 rotatably provided in the water tub 20 and accommodating the laundry therein.

The washing tub 70 is rotatably supported by a driving shaft 13 coupled to a rear surface portion 70*a* thereof and penetrating through the rear surface portion 20*b* of the water tub 20.

The driving shaft 13 is coupled to a driving motor 14. Therefore, the washing tub 70 may receive driving force of the driving motor 14 from the driving shaft 13 to rotate. The driving motor 14 rotates the washing tub 70 at a low speed in one direction or the other direction at the time of performing washing, and rotates the washing tub 70 at a high speed in one direction at the time of performing dehydration.

As described above, since the water tub 20 and the washing tub 70 are disposed in the direction horizontal to the installation surface of the washing machine 2, and the driving shaft 13 is also disposed in the direction horizontal to the installation surface of the washing machine 2. Therefore, a central axis line 13*a* of the driving shaft 13 may be parallel with the installation surface of the washing machine 2.

Figure 12:
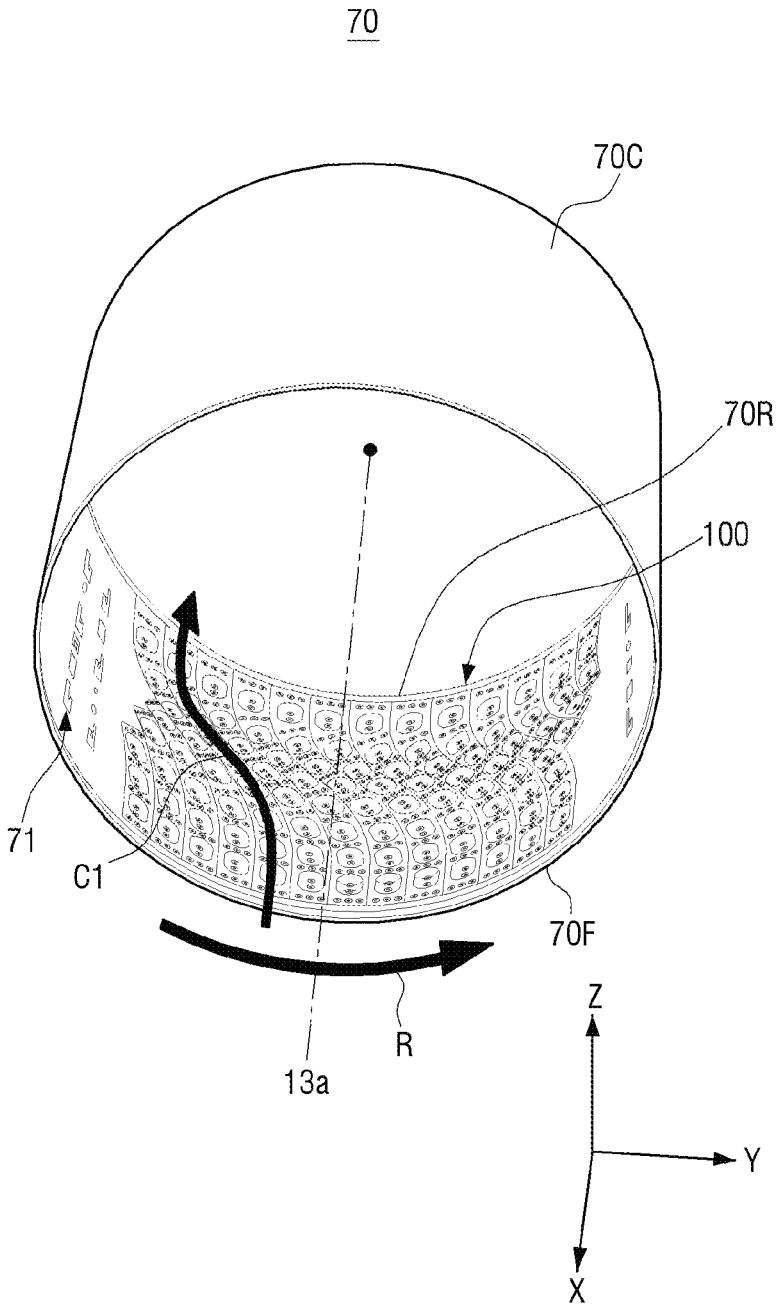
FIG. 12 is a perspective view of a washing tub illustrated in FIG. 11 when viewed from the front.
Figure 13:
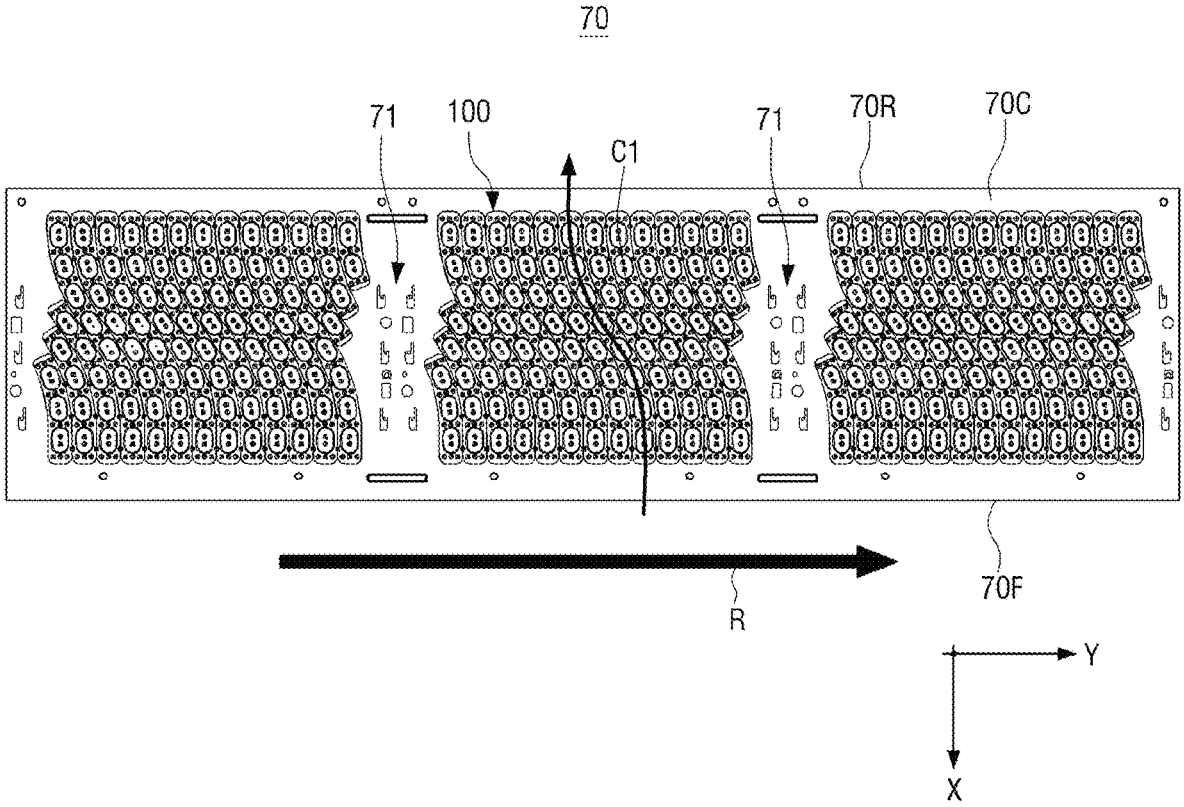
FIG. 13 is an exploded view of the washing tub illustrated in FIG. 12.

FIG. 12 is a perspective view of a washing tub 70 illustrated in FIG. 11 when viewed from the front, and FIG. 13 is an exploded view of the washing tub 70 illustrated in FIG. 12.

Hereinafter, the washing tub 70 according to yet still another exemplary embodiment of the present disclosure will be described with reference to FIGS. 11 through 13.

For convenience of explanation, a portion adjacent to a door 12 illustrated in FIG. 11 is defined as the front, and a portion adjacent to the driving motor 14 illustrated in FIG. 11 is defined as the rear. In addition, in illustrating the washing tub 70 in FIGS. 12 and 13, only a circumferential portion 70*c* having a plurality of protruding portions 100 formed on an inner surface thereof is illustrated, and a rear surface portion 70*a* and a front surface portion 70*b* that are omitted may be replaced, respectively, by the rear surface portion 30*a* and the front surface portion 30*b* illustrated in FIG. 2.

The washing tub 70 may have a cylindrical shape opened toward the front to be connected to the inlet 11 formed in the front surface of the washing machine 1. Since most of the configurations of the washing tub 70 are similar to those of the washing tub 30 illustrated in FIG. 2, a description for overlapping contents will be omitted.

The washing tub 70 includes the rear surface portion 70*a* coupled to the driving shaft 13, the front surface portion 70*b* in which an inlet 71 through which the laundry is injected is formed, and the circumferential portion 70*c* connecting the rear surface portion 70*a* and the front surface portion 70*b* to each other. In addition, a plurality of lifters 73 lifting and dropping the laundry depending on rotation of the washing tub 70 are installed on the inner surface of the circumferential portion 70*c*.

The inner surface of the circumferential portion 70*c* of the washing tub 70 configures an inner circumferential surface of the washing tub 70.

The inlet 71 of the washing tub 70 is connected to the inlet 11 formed in the front surface of the body 10. Therefore, the washing tub 70 may accommodate the laundry injected through the inlet 11 and the inlet 71 therein.

Referring to FIGS. 12 and 13, the washing tub 70 includes the plurality of protruding portions 100 protruding from the inner circumferential surface of the washing tub 70 toward an inner portion of the washing tub 70. In detail, the plurality of protruding portions 100 may be formed on the inner surface of the circumferential portion 70*c* to form a pattern. In describing a structure of the protruding portion 100, the inner circumferential surface of the washing tub 70 and the inner surface of the circumferential portion 70*c* indicate the same component, and may be used together.

The plurality of protruding portions 100 may be disposed in parallel with each other in the circumferential direction of the washing tub 70 to be easily in contact with the laundry injected into the washing tub 70.

The washing tub 70 includes a plurality of fastening portions 71 formed on the inner surface of the circumferential portion 70*c* and having the plurality of lifters 73 coupled thereto.

As illustrated in FIG. 13, the plurality of fastening portions 71 may be disposed, respectively, between the plurality of protruding portions 100 disposed in parallel with each other.

Therefore, the plurality of protruding portions 100 disposed in parallel with each other between the plurality of fastening portions 71 may configure the respective patterns, and the fastening portions 71 may be disposed between the respective patterns.

In addition, the plurality of fastening portions 71 include a plurality of fastening holes, respectively, and the plurality of lifters 73 may be coupled to the inner circumferential surface of the washing tub 70 through the fastening holes of the fastening portions 71 corresponding thereto, respectively.

Hereinafter, a structure of the plurality of protruding portions 100 will be described.

The respective protruding portions 100 protrude from the inner circumferential surface of the washing tub 70 toward the inner portion of the washing tub 70, and are extended from a portion of the inner circumferential surface of the washing tub 70 adjacent to the inlet 11 in a direction that becomes distant from the inlet 11.

In addition, the respective protruding portions 100 may be replaced by recessed portions concave from the inner circumferential surface of the washing tub 70 toward the outside. However, a case in which the respective protruding portions 100 protrude toward the inner portion of the washing tub 70 will hereinafter be described by way of example.

The plurality of protruding portions 100 protruding toward the inner portion of the washing tub 70 may have a shape in which they protrude inwardly from both ends of the respective protruding portions 100 in a width direction to be inclined upwardly, and surfaces of the respective protruding portions 100 may be curved surfaces.

The respective protruding portions 100 may be extended in the length direction of the washing tub 70. In addition, the respective protruding portions 100 may be extended from a front end 70F of the circumferential portion 70*c* adjacent to the inlet 11 to a rear end 70R of the circumferential portion 70*c* opposed to the front end 70F.

In addition, at least part of the respective protruding portions 100 are curved in a helix direction. The meaning that at least part of the respective protruding portions 100 are curved in the helix direction is that at least part of the respective protruding portions 100 are extended in a helix shape in the length direction of the washing tub 70 on the inner circumferential surface of the washing tub 70.

Therefore, the plurality of protruding portions 100 may interfere in the laundry in the washing tub 70, and move the laundry on the inner circumferential surface of the washing tub 70.

In detail, at least parts of the protruding portion 100 may be curved in the helix direction to move the laundry in the washing tub 70 in a desired direction in a process in which the washing machine 2 is operated in a dehydrating mode. As an example, the washing tub 70 according to exemplary embodiment of the present disclosure may be configured to rotate at a high speed in a counterclockwise direction at the time of performing the dehydration, and at least part of the respective protruding portions 100 may be configured to be curved in a right handed screw direction.

At least part of the respective protruding portions 100 are curved in the right handed screw direction, such that the laundry accommodated in the washing tub 70 may interfere in the plurality of protruding portions 100 and move from a portion adjacent to the inlet 11 in the direction that becomes distant from the inlet 11 along the plurality of protruding portions 100, during a period in which the washing tub 70 performs the dehydration of the laundry while rotating at the high speed in the counterclockwise direction. That is, the plurality of protruding portions 100 may guide the laundry accommodated in the washing tub 70 so that the laundry moves from the front end 70F of the washing tub 70 to the rear end 70R of the washing tub 70, at the time of performing the dehydration.

In addition, in the case in which the washing tub 70 is configured to rotate at a high speed in a clockwise direction at the time of performing the dehydration, at least part of the respective protruding portions 100 may be configured to be curved in a left handed screw direction to move the laundry in the washing tub 70 toward the rear end 70R of the washing tub 70 at the time of performing the dehydration.

In addition, it may be understood that at least part of the respective protruding portions 100 are curved in a direction opposed to a rotation direction of the washing tub 70.

The meaning that the plurality of protruding portions 100 are curved may be that portions or entirety of the plurality of protrusion portions 100 are curved while forming curved lines along the inner circumferential surface of the washing tub 70 formed as a curved surface.

In FIGS. 12 and 13, a rotation direction of the washing tub 70 rotating in the counterclockwise direction is denoted by an arrow "R", and a direction in which at least parts of the protruding portions 100 are curved in the right handed screw direction is denoted by an arrow "C1".

As described above, the rotation direction R of the washing tub 70 at the time of performing the dehydration may be set to the counterclockwise direction. In addition, the rotation direction R of the washing tub 70 rotating in the counterclockwise direction may be represented as a direction from the left toward the right in the exploded view of the washing tub 70 illustrated in FIG. 13.

As illustrated in FIG. 12, at least part of the protruding portions 100 may have a helix shape curved in the right handed screw direction.

In addition, in the case in which the washing tub 70 is viewed from the top of the front of the washing tub 70, it may be understood that the direction C1 in which the respective protruding portions 100 positioned at a lower portion of an inner side of the washing tub 70 are curved is the direction from the right toward the left. However, since the washing tub 70 rotates, in the case in which the washing tub 70 is viewed from the bottom of the front of the washing tub 70, a direction in which the respective protruding portions 100 positioned at an upper portion of the inner side of the washing tub 70 are curved is viewed as a direction from the left toward the right.

Referring to FIG. 13, in the washing tub 70 rotating in the counterclockwise direction, a rotation direction R of the circumferential portion 70*c* may be represented by the direction from the left toward the right in the exploded view of the washing tub 70.

In addition, the direction C1 in which the respective protruding portions 100 are curved may be represented to be inclined in the direction from the right toward the left. Therefore, it may be described that the direction in which at least part of the respective protruding portions 100 are curved is the direction opposed to the rotation direction of the washing tub 70.

In manufacturing the washing tub 70 according to yet still another exemplary embodiment of the present disclosure, the circumferential portion 70*c* may be manufactured by forming the plurality of protruding portions 100 curved in the direction C1 from the right toward the left on a metal plate having a rectangular shape and curving the metal plate on which the plurality of protruding portions 100 are formed in a cylindrical shape.

Therefore, at least part of the respective protruding portions 100 formed on the inner circumferential surface of the washing tub 70 having the cylindrical shape may be configured to be curved in the right handed screw direction to correspond to the washing tub 70 rotating in the counterclockwise direction, and the plurality of protruding portions 100 may move the laundry gathered toward the inlet 11 at the time of performing the dehydration toward the rear end 70R of the washing tub 70. However, it is preferable that the respective protruding portions 100 are curved in a level enough to move the laundry from the front end 70F of the washing tub 70 toward the rear end 70R of the washing tub 70 and preventing the laundry from being gathered toward the rear surface portion 70*a* of the washing tub 70. For example, in FIG. 13, the direction C1 in which at least part of the respective protruding portions 100 are curved may form an obtuse angle with respect to the rotation direction R of the washing tub 70, and the obtuse angle may exceed 90 degrees and be 135 degrees or less.

In addition, in describing a relationship between the rotation direction of the washing tub 70 at the time of performing the dehydration and the direction in which the protruding portions 100 are curved, the washing tub 70 may be divided into an upper portion and a lower portion on the basis of the central axis line 13*a* illustrated in FIG. 12.

In describing the washing tub 70 rotating the counterclockwise direction and the plurality of protruding portions 100 curved in the direction opposed to the rotation direction R of the washing tub 70, the respective protruding portions 100 positioned at the lower portion of the washing tub 70 move in the direction from the left toward the right, and at least part of the respective protruding portions 100 positioned at the lower portion of the washing tub 70 are curved in the direction from the right toward the left.

In addition, the protruding portions 100 positioned at the upper portion of the washing tub 70 move in the direction from the right toward the left, and at least part of the respective protruding portions 100 disposed at the upper portion of the washing tub 70 are curved in the direction from the left toward the right. However, since the washing tub 70 rotates around the central axis line 13*a*, the upper portion and the lower portion of the washing tub 70 described above are relative portions of the washing tub 70 that rotates.

Therefore, the meaning that at least part of the respective protruding portions 100 are curved in the direction opposed to the rotation direction R of the washing tub 70 may be that at least part of the respective protruding portions 100 are curved in a direction opposed to an instantaneous moving direction of the respective protruding portions 100 depending on rotation of the washing tub 70, and may also be that at least part of the respective protruding portions 100 are curved in the direction opposed to the rotation direction R of the washing tub 70 in an exploded view of the circumferential portion 70*c*.

As described above, the plurality of protruding portions 100 protruding on the inner circumferential surface of the washing tub 70 may be curved in the direction opposed to the rotation direction R of the washing tub 70 to move the laundry in the washing tub 70 that rotates in the direction that becomes distant from the inlet 11.

In addition, the plurality of protruding portions 100 may be continuously disposed in the circumferential direction of the washing tub 70 to effectively move the laundry that is in contact with the inner surface of the circumferential portion 70*c* and rotates from the front to the rear.

Therefore, the washing tub 70 including the plurality of protruding portions 100 may prevent the laundry from being moved and gathered toward the inlet 11 in washing and dehydrating processes, and prevent the laundry from being sandwiched and damaged in a gap between the inlet 11 and the door 12 or a diaphragm (not illustrated).

A structure moving the laundry from the front end 70F of the washing tub 70 to the rear end 70R of the washing tub 70 through the plurality of protruding portions 100 to prevent the laundry from being gathered and damaged toward the inlet 11 at the time of performing the dehydration is described by way of example in the abovementioned exemplary embodiments, but the present disclosure is not limited thereto. That is, the laundry in the washing tub 70 may move in a desired direction in a dehydrating process by changing the direction and a level in which at least part of the respective protruding portions 100 are curved.

Figure 14:
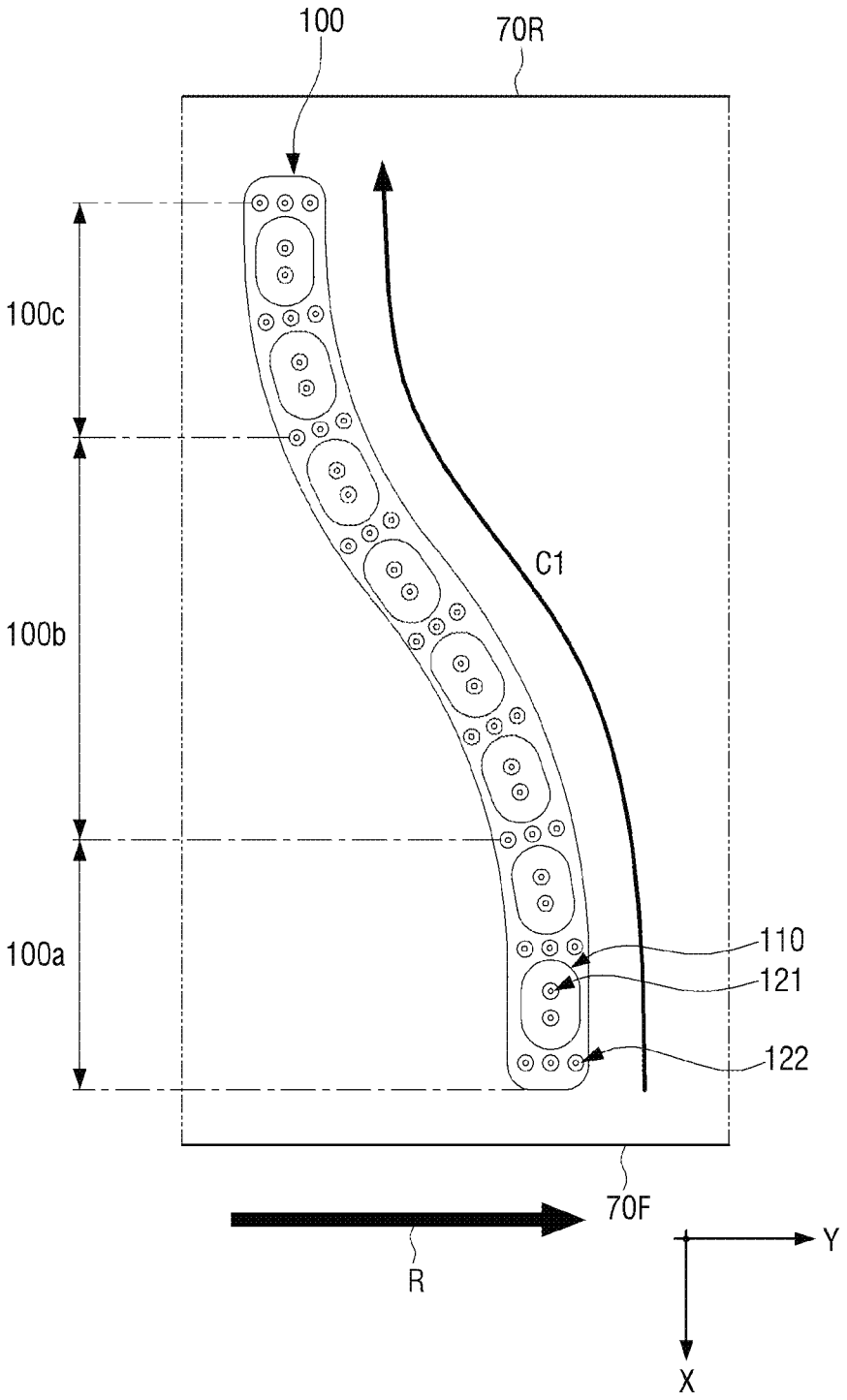
FIG. 14 is an enlarged view of a protruding portion illustrated in FIG. 13.

FIG. 14 is an enlarged view of a protruding portion 100 illustrated in FIG. 13.

Referring to FIG. 14, each protruding portion 100 includes a front end portion 100*a* adjacent to the inlet 11, a central portion 100*b* connected to the front end portion 100*a*, and a rear end portion 100*c* connected to the central portion 100*b*.

As illustrated in FIG. 14, the front end portion 100*a* of the protruding portion 100 adjacent to the inlet 11 may be a portion of the protruding portion 100 adjacent to the front end 70F of the washing tub 70, and the rear end portion 100*c* of the protruding portion 100 may be a portion of the protruding portion 100 adjacent to the rear end 70R of the washing tub 70.

In addition, the central portion 100*b* is curved in the helix direction. As an example, in the case in which the washing tub 70 is configured to rotate in the counterclockwise direction at the time of performing the dehydration, the central portion 100*b* may be configured to be curved in the right handed screw direction. That is, the central portion 100*b* is curved in the direction C1 opposed to the rotation direction R of the washing tub 70, and the front end portion 100*a* and the rear end portion 100*c* may be formed in parallel with a shaft (the driving shaft 13) of the washing tub 70.

As described above, the washing tub 70 may be configured to rotate in the counterclockwise direction at the time of performing the dehydration and the central portion 100*b* of the protruding portion 100 may be curved in the right handed screw direction to move the laundry interfering in the central portion 100*b* at the time of performing the dehydration toward the rear end portion 100*c*.

That is, the central portion 100*b* of each protruding portion 100 may be curved in the direction C1 opposed to the rotation direction R of the washing tub 70 to move the laundry in contact with the central portion 100*b* toward the rear end portion 100*c*.

In addition, the rear end portion 100*c* is formed in parallel with the driving shaft 13, such that the laundry moved to the rear end portion 100*c* may be moved forward and rearward on the rear end portion 100*c*. Therefore, the rear end portion 100*c* may disperse the laundry on the rear end portion 100*c* and prevent the laundry from being lumped or twisted on the rear surface portion 70*a* of the washing tub 70.

In addition, the front end portion 100*a* is also formed in parallel with the driving shaft 13, such that the laundry on the front end portion 100*a* may be dispersed. Therefore, the laundry on the front end portion 100*a* may more effectively enter the central portion 100*b*.

It is preferable that the central portion 100*b* of each protruding portion 100 is configured to be longer than the front end portion 100*a* and the rear end portion 100*c* to effectively guide movement of the laundry.

In addition, the entirety of each protruding portion 100 may be configured to be curved in the right handed screw direction without being divided into the front end portion 100*a*, the central portion 100*b*, and the rear end portion 100*c*, and the entirety of the protruding portion 100 may be configured to be curved in the direction C1 opposed to the rotation direction R of the washing tub 70. In addition, the protruding portion 100 may include only a front end portion 100*a* and a central portion 100*b* or only a central portion 100*b* and a rear end portion 100*c*.

However, a detailed structure of each protruding portion 100 is not limited to the example described above, but may be replaced by various structures in which the protruding portion 100 is curved so that the laundry moves from a portion adjacent to the inlet 11 in the direction that becomes distant from the inlet 11 along the protruding portion 100.

Figure 15:
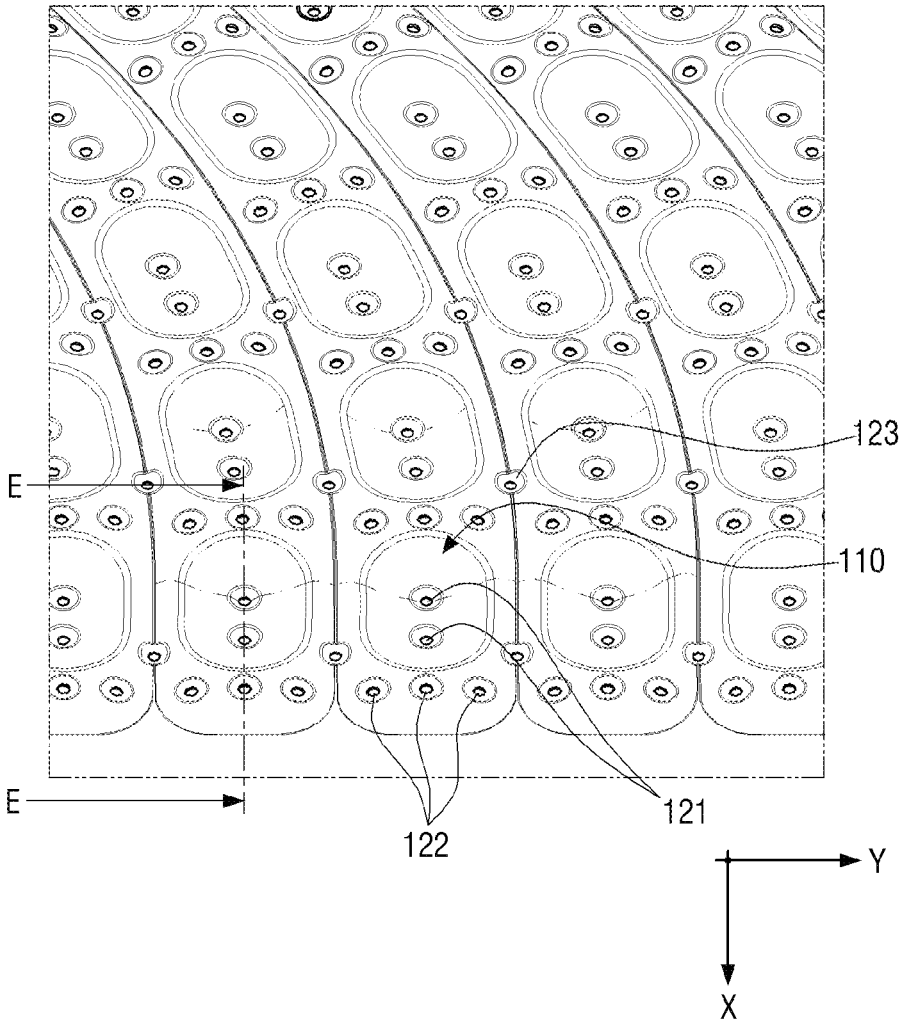
FIG. 15 is a partially enlarged perspective view of the washing tub illustrated in FIG. 12.
Figure 16:
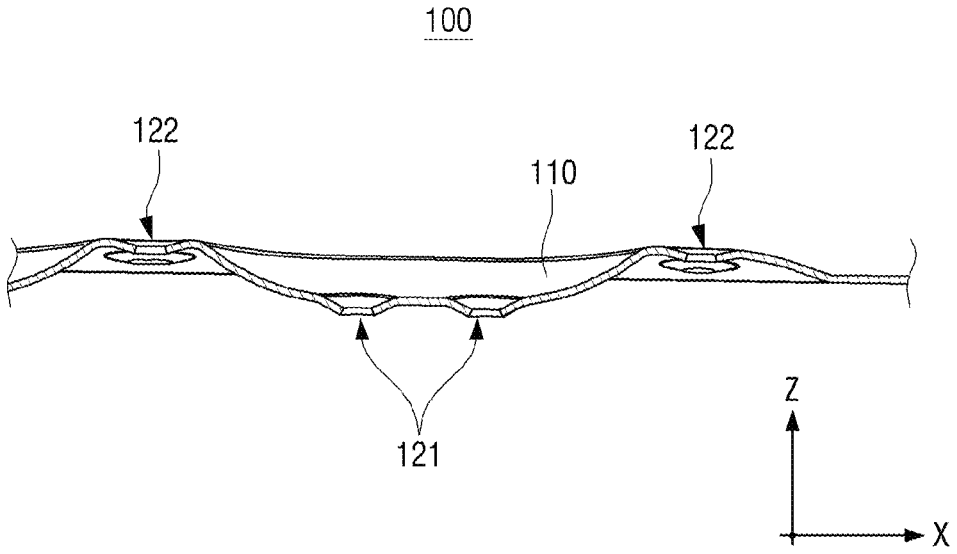
FIG. 16 is a cross-sectional view taken along line E-E of the washing tub illustrated in FIG. 15.

FIG. 15 is a partially enlarged perspective view of the washing tub 70 illustrated in FIG. 12, and FIG. 16 is a cross-sectional view taken along line E-E of the washing tub 70 illustrated in FIG. 15.

Referring to FIGS. 14 to 16, each protruding portion 100 includes a plurality of recessed portions 110 formed in the length direction of the protruding portion 100.

Each protruding portion 100 protrudes from the inner circumferential surface of the washing tub 70 toward the inner portion of the washing tub 70, and the plurality of recessed portions 110 formed in the protruding portion 100 are formed to be concave from the inner circumferential surface of the washing tub 70 toward the outside of the washing tub 70.

Therefore, in each protruding portion 100, the protruding portions protruding from the inner circumferential surface of the washing tub 70 and the recessed portions 110 concave from the inner circumferential surface of the washing tub 70 are sequentially disposed in the direction that becomes distant from the inlet 11. Therefore, the laundry may more effectively move from the inlet 11 in the direction that becomes distant from the inlet 11.

In addition, the respective recessed portions 110 may have an oval shape extended in the length direction of the protruding portion 100. Therefore, the laundry may more effectively move from the front of the washing tub 70 to the rear of the washing tub 70 along the plurality of protruding portion 100.

In addition, the washing tub 70 includes a plurality of dehydrating holes 121, 122, and 123 formed in the plurality of protruding portions 100.

In detail, the respective protruding portions 100 include at least one first dehydrating hole 121 formed in the recessed portions 110.

Water separated from the laundry in the dehydrating process may easily move to the recessed portions 110, and the water moving to the recessed portions 110 may be easily drained to the outside of the washing tub 70 through the first dehydrating holes 121.

Although a case in which two first dehydrating holes 121 are formed in each recessed portion 110 is illustrated by way of example in FIGS. 14 to 16, a size and the number of first dehydrating holes 121 formed in the recessed portion 110 may be variously modified.

In addition, the protruding portions 100 described above may be replaced by a plurality of recessed portions forming the pattern of the washing tub and formed to be concave from the inner circumferential surface of the washing tub. In this case, a plurality of protruding portions may be formed in each recessed portion extended in the length direction of the washing tub. In addition, the first dehydrating holes may be formed between an inner side of the recessed portion and an outer side of the protruding portion to easily drain the water moving to the inner side of the concave recessed portion.

In addition, the respective protruding portions 100 include at least one second dehydrating hole 122 formed between the plurality of recessed portions 110.

As illustrated in FIGS. 14 and 15, three second dehydrating holes 122 may be disposed in the width direction of the protruding portion 100, respectively, between the plurality of recessed portions 110.

The second dehydrating holes 122 may be formed between each recessed portion 110 formed in the protruding portion 100 and a recessed portion 110 adjacent to the recessed portion 110 to more effectively drain the water in the washing tub 70 to the outside.

In addition, the washing tub 70 includes at least one third dehydrating hole 123 formed between the plurality of protruding portions 100.

Since the plurality of protruding portions 100 formed on the inner circumferential surface of the washing tub 70 protrude toward the inner portion of the washing tub 70, spaces between the plurality of protruding portions 100 have a height lower than that of the protruding portions 100. Therefore, the water separated from the laundry in the dehydrating process may easily move between the plurality of protruding portions 100.

Therefore, the third dehydrating holes 123 formed between the plurality of protruding portions 100 may easily drain the water moving between the plurality of protruding portions 100 to the outside of the washing tub 70.

In addition, since the plurality of protruding portions 100 are continuously disposed in the circumferential direction of the washing tub 70, the third dehydrating holes 123 may be formed on a boundary between each protruding portion 100 and a protruding portion 100 adjacent to each protruding portion 100. In addition, a plurality of third dehydrating holes 123 may be disposed in the length direction of the protruding portions 100 on the boundaries between the plurality of protruding portions 100.

Figure 17:
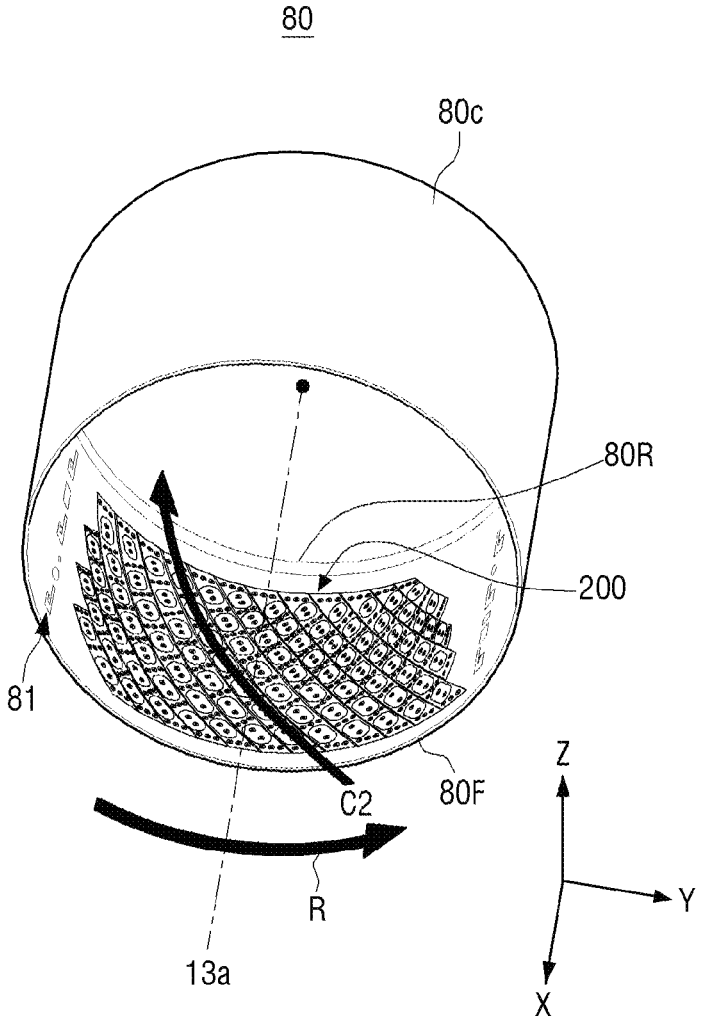
FIG. 17 is a perspective view of a washing tub according to yet still another exemplary embodiment of the present disclosure when viewed from the front.
Figure 18:
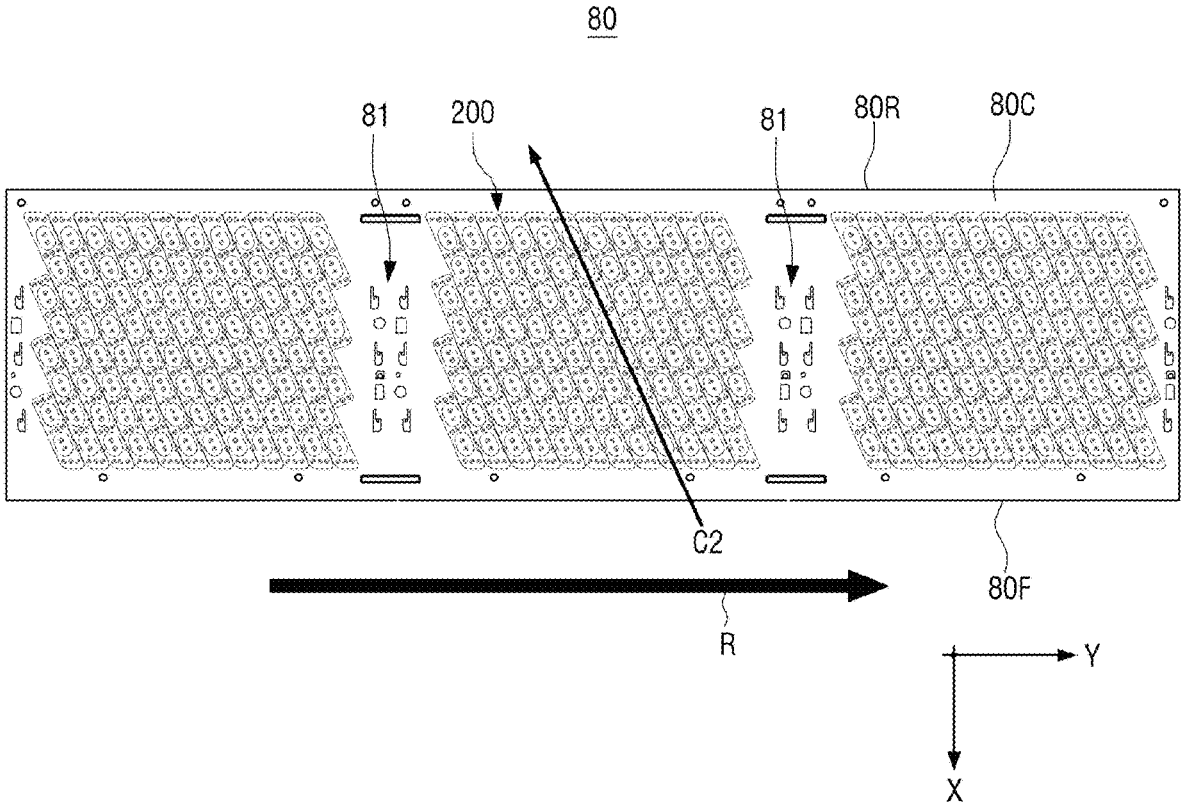
FIG. 18 is an exploded view of the washing tub illustrated in FIG. 17.

FIG. 17 is a perspective view of a washing tub 80 according to yet still another exemplary embodiment of the present disclosure when viewed from the front, and FIG. 18 is an exploded view of the washing tub 80 illustrated in FIG. 17.

Hereinafter, a structure of the washing tub 80 according to yet still another exemplary embodiment of the present disclosure will be described with reference to FIGS. 17 and 18.

However, since most of the structures of the washing tub 80 illustrated in FIGS. 17 and 18 are the same as those of the washing tub 70 illustrated in FIGS. 12 and 13, a description for overlapping contents will be omitted.

The washing tub 80 includes a plurality of protruding portions 200 protruding on an inner surface thereof. The plurality of protruding portions 200 are formed on an inner surface of a circumferential portion 80*c* (an inner circumferential surface of the washing tub 80), and the respective protruding portions 200 are extended from a portion adjacent to the inlet 11 in the direction that becomes distant from the inlet 11.

In addition, it may be understood that at least part of the respective protruding portions 200 are curved in a helix direction and are curved in a direction C2 opposed to a rotation direction R of the washing tub 80.

In detail, as illustrated in FIG. 17, the rotation direction R of the washing tub 80 at the time of performing dehydration may be set to the counterclockwise direction, and at least parts of the protruding portions 200 are configured to be curved in the right handed screw direction.

In addition, the rotation direction R of the washing tub 80 rotating in the counterclockwise direction may be represented as a direction from the left toward the right in the exploded view of the washing tub 80 illustrated in FIG. 18. In addition, the respective protruding portions 200 may have a linear shape inclined in the direction opposed to the rotation direction R of the washing tub 80 in the exploded view of the circumferential portion 80*c*.

In manufacturing the washing tub 80 according to yet still another exemplary embodiment of the present disclosure, the circumferential portion 80*c* may be manufactured by forming the plurality of protruding portions 200 having the linear shape inclined in the direction C2 from the right toward the left on a metal plate having a rectangular shape and curving the metal plate on which the plurality of protruding portions 200 are formed in a cylindrical shape. Therefore, at least part of the respective protruding portion 200 formed on the inner surface of the washing tub 80 may be configured to be curved in the right handed screw direction to correspond to the washing tub 80 rotating in the counterclockwise direction, and the respective protruding portions 200 may be curved in the direction C2 opposed to the rotation direction R of the washing tub 70 rotating in the counterclockwise direction.

In addition, each of the plurality of protruding portions 200 formed on the inner surface of the washing tub 80 may have a helix shape extended from a front end 80F of the washing tub 80 toward a rear end 80R of the washing tub 80 in the direction opposed to the rotation direction of the washing tub 80.

Therefore, the plurality of protruding portions 200 formed on the inner surface of the washing tub 80 may move the laundry in the washing tub 80 from a portion adjacent to the inlet 11 in the direction that becomes distant from the inlet 11, and prevent the laundry from being sandwiched and damaged between the inlet 11 and the door 12.

In addition, each protruding portion 200 includes a plurality of recessed portions formed in the length direction of the protruding portion 200, and a water tub includes a plurality of dehydrating holes formed in an inner surface thereof.

Since structures of the plurality of recessed portions formed in each protruding portion 200 and the plurality of dehydrating holes are similar to those of the recessed portions 110 and the first to third dehydrating holes 121, 122, and 123 illustrated in FIG. 15, a description for overlapping contents will be omitted.

As described above, in the washing machine 2 according to another exemplary embodiment of the present disclosure, at least parts of the plurality of protruding portions 100 or 200 protruding on the inner surface of the washing tub 70 or 80 may be curved in the right handed screw direction (at least parts of the protruding portions 100 or 200 may be curved in the direction C2 opposed to the rotation direction R of the washing tub 70 or 80) to correspond to the washing tub 70 or 80 configured to rotate in the counterclockwise direction at the time of performing the dehydration to move the laundry adjacent to the inlet 11 in the direction that becomes distant from the inlet 11. Therefore, a phenomenon that the laundry in the washing tub 70 or 80 that rotates is gathered toward the inlet 11 to be sandwiched between the inlet 11 and the door 12 may be prevented.

In addition, the washing tub 70 or 80 may include the first and second dehydrating holes 121 and 122 each formed in the plurality of protruding portions 100 or 200 and the third dehydrating holes 123 formed between the plurality of protruding portions 100 to effectively improve a moisture content.

Although the diverse exemplary embodiments of the present disclosure have been individually described hereinabove, the respective exemplary embodiments are not necessarily implemented singly, but may also be implemented so that configurations and operations thereof are combined with those of one or more other exemplary embodiments.

In addition, specific exemplary embodiments have been illustrated and described hereinabove. However, the present disclosure is not limited to only the abovementioned exemplary embodiments, but may be variously modified by those skilled in the art to which the present disclosure pertains without departing from the scope and spirit of the present disclosure stated in the claims.

The invention claimed is:

1. A washing machine comprising:

a body configured to have an inlet formed in a front surface thereof;

a washing tub configured to be rotatably disposed in the body, accommodate a laundry injected through the inlet therein, and have a cylindrical shape; and a plurality of protruding portions configured to protrude from an inner circumferential surface of the washing tub toward an inner portion of the washing tub to form a pattern, wherein each protruding portion, of the plurality of protruding portions, includes a front end portion adjacent to the inlet, a central portion connected to the front end portion and a rear end portion connected to the central portion, wherein the front end portion and the rear end portion transition to the central portion along curving arcs in a helix direction from a portion adjacent to the inlet in a direction that becomes distant from the inlet, and the front end portion and the rear end portion are formed in parallel with a shaft of the washing tub, and wherein each protruding portion, of the plurality of protruding portions, includes a plurality of recessed portions formed in a length direction from the front end portion to the rear end portion of the protruding portion, and the plurality of recessed portions comprise an oval shape extended in the length direction from the front end portion to the rear end portion of the protruding portion.

2. The washing machine as claimed in claim 1, wherein:

the washing tub is configured to rotate in a counterclockwise direction at a time of performing dehydration, and the central portion of the protruding portions is curved in a right handed screw direction.

3. The washing machine as claimed in claim 1, wherein the at least one protruding portion includes at least one first dehydrating hole formed in at least one of the recessed portions.

4. The washing machine as claimed in claim 1, wherein the at least one protruding portion includes at least one second dehydrating hole formed between the plurality of recessed portions.

5. The washing machine as claimed in claim 1, wherein the plurality of protruding portions are disposed in parallel with each other in a circumferential direction of the washing tub.

6. The washing machine as claimed in claim 5, wherein the washing tub includes at least one third dehydrating hole formed between the plurality of protruding portions.

* * * * *